US011358250B2

(12) United States Patent
Kojima et al.

(10) Patent No.: US 11,358,250 B2
(45) Date of Patent: Jun. 14, 2022

(54) SPHERICAL LENS SURFACE PROCESSING METHOD AND SPHERICAL LENS SURFACE PROCESSING APPARATUS WITH CUP-SHAPED GRINDING STONE

(71) Applicant: Kojima Engineering Co., Ltd., Nagano (JP)

(72) Inventors: Hideo Kojima, Nagano (JP); Hiroshi Fukuzawa, Nagano (JP); Tetsuya Jowa, Nagano (JP)

(73) Assignee: KOJIMA ENGINEERING CO., LTD., Nagano (JP)

( * ) Notice: Subject to any disclaimer, the term of this patent is extended or adjusted under 35 U.S.C. 154(b) by 830 days.

(21) Appl. No.: 16/315,693

(22) PCT Filed: Jul. 8, 2016

(86) PCT No.: PCT/JP2016/070347
§ 371 (c)(1),
(2) Date: Jan. 7, 2019

(87) PCT Pub. No.: WO2018/008158
PCT Pub. Date: Jan. 11, 2018

(65) Prior Publication Data

US 2021/0276139 A1 Sep. 9, 2021

(51) Int. Cl.
*B24B 13/04* (2006.01)
*B24B 13/02* (2006.01)

(52) U.S. Cl.
CPC ..... *B24B 13/043* (2013.01); *B24B 13/02* (2013.01)

(58) Field of Classification Search
CPC ... B24B 49/006; B24B 49/16; B24B 13/0006; B24B 13/0012; B24B 13/0018;
(Continued)

(56) References Cited

U.S. PATENT DOCUMENTS 2,357,154 A * 8/1944 Wilhelm ..... B24B 9/14 451/10
2,585,365 A * 2/1952 Allen ..... B24B 41/00 451/388
(Continued)

FOREIGN PATENT DOCUMENTS

DE 2659489 A1 7/1978
GB 681311 * 5/1950 ..... B24B 9/14
(Continued)

OTHER PUBLICATIONS

International Search Report (PCT/ISA/210) dated Aug. 16, 2016, by the Japanese Patent Office as the International Searching Authority for International Application No. PCT/JP2016/070347.
(Continued)

*Primary Examiner* — Orlando E Aviles
*Assistant Examiner* — Jason Khalil Hawkins
(74) *Attorney, Agent, or Firm* — Buchanan Ingersoll & Rooney PC

(57) ABSTRACT

In a spherical lens surface processing method, a lens surface is ground to a spherical surface by forming a contact state in which a rotating cup-shaped grinding stone is placed in contact with the lens surface and a sphere center oscillation state in which the cup-shaped grinding stone oscillates along the lens surface centered on a sphere center. In the sphere center oscillation state, the distance from the center of the sphere center oscillation to the contact point of the cup-shaped grinding stone with the lens surface is set to be the same as the radius of the spherical surface. The oscillation width of the sphere center oscillation is set so that the contact point of the cup-shaped grinding store with the lens surface can move from one peripheral edge of the lens surface past the lens center on the lens surface to the other peripheral edge.

6 Claims, 6 Drawing Sheets

(58) Field of Classification Search
CPC ..... B24B 13/0025; B24B 13/005; B24B 13/0043; B24B 13/01; B24B 13/02; B24B 13/043; B24B 13/06; B24B 9/14; B24B 9/142
USPC ..... 451/5, 10, 11, 42, 123, 14, 6, 255, 256, 451/290, 291, 384, 388, 390, 921
See application file for complete search history.

(56) References Cited

U.S. PATENT DOCUMENTS 3,295,417 A * 1/1967 Hanlon ..... B24B 9/14 409/110
2004/0058624 A1* 3/2004 Suzuki ..... B24B 9/146 451/42
2012/0045975 A1* 2/2012 Kojima ..... B24B 13/02 451/294
2016/0008944 A1* 1/2016 Chen ..... B24B 9/14 451/256
2017/0182622 A1* 6/2017 Kojima ..... B24B 13/02

FOREIGN PATENT DOCUMENTS

JP H071311 A 1/1995
JP 2004188557 A 7/2004
JP 2009066724 A 4/2009
JP 2009178834 A 8/2009
KR 20040034052 A * 4/2004 ..... B24B 13/005

OTHER PUBLICATIONS

Written Opinion (PCT/ISA/237) dated Aug. 16, 2016, by the Japanese Patent Office as the International Searching Authority for International Application No. PCT/JP2016/070347.

* cited by examiner

SPHERICAL LENS SURFACE PROCESSING METHOD AND SPHERICAL LENS SURFACE PROCESSING APPARATUS WITH CUP-SHAPED GRINDING STONE

TECHNICAL FIELD

The present invention relates to a spherical lens surface processing method and a spherical lens surface processing apparatus in which a spherical lens surface is ground with a cup-shaped grinding stone.

BACKGROUND ART

Glass lenses are commonly manufactured through the steps of rough grinding (crude rubbing), precision grinding, polishing, and centering, and the rough grinding and precision grinding involve the use of different processing apparatuses and different grinding stones. For example, in the rough grinding of the processing of a spherical lens surface, curved surface processing is performed on the lens surface of a lens material by a curve generator (CG machine), using a diamond wheel or another cup-shaped grinding stone. In the subsequent precision grinding, the processing is performed by a sphere-center-type processing apparatus using a diamond pellet plate or another plate-shaped grinding stone, and the lens material is finished to a lens having the necessary surface accuracy and center thickness.

To minimize changes in plate-shaped grinding stones for precision grinding and reduce the amount of processing done with plate-shaped grinding stones according to recent requirements to improve lens processing precision, to reduce processing time, etc., the shape after rough grinding with a CG machine has needed to be closer to a perfect sphere, surface roughness has needed to be lessened, thickness (of a center part after both lens surfaces have been processed) has needed to be kept fixed, the optical axes of both lens surfaces have needed to be in alignment, etc.

However, it is extremely difficult to make a processed curved surface into a perfect sphere with a CG machine. This matter is described with reference to FIGS. 5A and 5B, which show the principle of processing by a prior-art CG machine.

A lens 105A (105B) is fixed to and held in a rotating chuck 104, and with the lens tilted at an incline angle θa (θb) in relation to a lens rotation axis 113, the lens moves in the direction A of a rotating cup-shaped grinding stone 109A (109B), and cut-processing is performed. The incline angle θa (θb) is determined with the following formula, involving the spherical surface radius R of the lens 105A (105B) being processed, and the contact diameter φT of the cup-shaped grinding stone 109A (109B) and the lens 105A (105B).

$$\sin \theta a = \varphi T/2R$$

$$\sin \theta b = \varphi T/2R$$

The point at which the lens processed surface 105*a* (105*b*) becomes a perfect sphere is the point at which the point where the cup-shaped grinding stone 109A (109B) makes contact with the lens 105A (105B), perfectly aligns with the lens center P2. When the center is offset even slightly, depressions and protrusions are produced in the center of the processed lens 105A (105B), and the lens will not be a perfect sphere. Consequently, a mechanism is provided for moving the cup-shaped grinding stone 109A (109B) back and forth so as to align with this point, and this mechanism is used to make adjustments.

However, a high level of technology and experience are needed to correct positional offsetting caused by wear of the cup-shaped grinding stone 109A (109B). This is because the effects of wear in the cup-shaped grinding stone 109A (109B) show in both the radius and the shape of the created lens surface. Additionally, the worn tip end shape of the cup-shaped grinding stone 109A (109B) cannot be specified, and because the curved surface shape created in the lens surface is not a spherical surface, it is not viable to calculate the contact diameter φT of the lens 105A (105B) and the cup-shaped grinding stone 109A (109B) for calculating the incline angle θa (θb) anew. Consequently, the incline angle θa (θb) and the longitudinal position of the cup-shaped grinding stone 109A (109B) must continue to be adeptly adjusted in accordance with the wear of the cup-shaped grinding stone 109A (109B), on the basis of the experience of a skilled worker.

The surface roughness is affected by the lens material and the grinding stone material, but is primarily determined by the apparatus mechanisms. The lens is pushed at a fixed speed against the rotating cup-shaped grinding stone while being held by a chuck and forcibly rotated. When a rotational speed or pushing speed exceeding the cutting performance of the cup-shaped grinding stone is reached, slight positional offsetting occurs due to flexure of the apparatus or the chuck. The amount by which the cup-shaped grinding stone digs into the lens thereby changes, and a chrysanthemum pattern referred to as tool marks is therefore produced in the lens surface as a result. There is also displacement of the lens during forced rotation, and undulation occurs in the processed surface. Grinding with zero depth of cut, an action referred to as sparking-out, is performed at the moving end of the lens in order to reduce tool marks and undulation, but the cup-shaped grinding stone digs in and deeply cut portions cannot be eliminated.

It is also further difficult to keep the thickness fixed or to bring the optical axes into alignment. Because the lens is held by a chuck, the lens outer periphery is the reference for chucking. Because the chucking position changes when there is strain in the lens outer periphery, the rotational center in a chucked state does not align between the already processed surface and the yet-to-be-processed surface, and the lens cannot be held at a right angle to the rotational axis of the chuck.

There is also a restriction on the contact diameter between the cup-shaped grinding stone and lens used. Referring to FIGS. 5A and 5B, the mechanisms of the apparatus are also a factor, but generally, the maximum angle of the incline angle θa (θb) of the cup-shaped grinding stone 109A (109B) is approximately 45°. Therefore, for the cup-shaped grinding stone 109A (109B) that can be used, the contact diameter φT with the lens 105A, 105B is limited to the range of the following formula. L1 in this formula represents the chord length of an arc from the lens center P2 to the outer peripheral end edge in the lens processed surface 105*a* (105*b*) that is being processed.

$$1.4 \times \text{processing radius} > \text{contact diameter } \varphi T > L1$$

To avoid the undesirable effects described above, processing the lens material (cut material, pressed material) by means of a sphere-center-type processing apparatus using a plate-shaped grinding stone from the beginning has been considered. However, in this case, the lens material partially comes into contact with the plate-shaped grinding stone at the start of processing. As a result, the periphery of the lens material will get chipped, the plate-shaped grinding stone will wear in parts, the plate-shaped grinding will not have a stable shape, and the precision with which the spherical lens surface is processed will be unstable.

The purposes of processing using a prior-art plate-shaped grinding stone are to improve the precision of curvature in the lens surface, to establish the thickness of the lens center, and to improve surface roughness. Therefore, the plate-shaped grinding stone used is finely textured, and the cut amount per unit time is lessened. When such a finely textured plate-shaped grinding stone is used for processing starting with a lens material, the cut amount is greater and the processing time is therefore longer, which is impractical.

Various structures of sphere-center-type processing apparatuses are known. Patent Document 1 proposes a lens processing apparatus that can move a grinding stone in various configurations including sphere center oscillation, without the use of a cam mechanism.

PRIOR ART LITERATURE

Patent Documents

Patent Document 1: JP-A 2009-178834

SUMMARY OF THE INVENTION

Problems to be Solved by the Invention

Thus, in the prior art, spherical lens surfaces are processed using different processing machines and different grinding stones. To achieve the necessary surface precision and center thickness, processing machines are also adjusted according to the experience and intuition of a skilled practitioner.

An object of the present invention is to provide a spherical lens surface processing method and a spherical lens surface processing apparatus with which a spherical lens surface can be processed with a high degree of precision using one processing machine and one type of grinding stone.

Means of Solving the Problems

To solve the above problems, a spherical lens surface processing method of the present invention including the steps of:

forming a contact state in which a rotating cup-shaped grinding stone is brought into contact at a predetermined pressure with a lens surface of a glass lens to be processed;

while maintaining the contact state, forming a state of sphere center oscillation in which the cup-shaped grinding stone oscillates along the lens surface centered on a sphere center as an oscillation center, and grinding the lens surface to a spherical surface having a predetermined surface precision and center thickness;

wherein, in the sphere center oscillation, a distance from the oscillation center to a point where the cup-shaped grinding stone makes contact with the lens surface is set to be equal to the radius of the sphere surface; and an oscillation width of the sphere center oscillation is set so that the point where the cup-shaped grinding stone makes contact with the lens surface moves past the lens center on the lens surface, from one outer peripheral edge side to the other outer peripheral edge side of the lens surface.

According to the present invention, the lens surface is processed to a spherical surface while the cup-shaped grinding stone is caused to undergo sphere center oscillation and the point where the cup-shaped grinding stone makes contact with the lens surface is moved reciprocatingly past the lens center along the lens surface. Due to this configuration, it is possible to eliminate depressions, protrusions, etc., produced in the lens center when spherical surface processing is performed by a CG machine using the cup-shaped grinding stone, and to process the lens surface to a perfectly spherical state. There is also no need to perform rough grinding with a CG machine in advance, as in the case of using a plate-shaped grinding stone.

According to the present invention, grinding time can be reduced to a much greater extent than with processing a spherical surface in a lens from the start using a plate-shaped grinding stone. Furthermore, when a plate-shaped grinding stone is used, a problem arises in that the lens material will come into partial contact with the plate-shaped grinding stone at the start of processing, the periphery of the lens material will get chipped, the plate-shaped grinding stone will be worn in parts, the shape of the plate-shaped grinding stone will be unstable, and the precision with which the spherical lens surface is processed will be unstable. Such problems can be resolved.

Thus, in the method of the present invention, a spherical lens surface is processed with novel use made of a combination of a cup-shaped grinding stone and sphere center oscillation, on which there had been no focus in the prior art. Processing a spherical lens surface in the prior art has been performed in two steps: rough grinding and precision grinding. Additionally, rough grinding has been performed by a curve generator (CG machine) using a cup-shaped grinding stone, and the subsequent precision grinding has been performed by a sphere-center-type processing apparatus using a plate-shaped grinding stone, to obtain a spherical lens surface having the necessary surface precision and center thickness. According to experimentation by the present inventors, it has been confirmed that a spherical lens surface can be processed with a precision equal to or greater than that of spherical lens surface processing in the prior art, by one sphere center oscillation-type processing apparatus using one type of grinding stone (a cup-shaped grinding stone).

Furthermore, according to the present invention, the oscillation width of the sphere center oscillation is set so that the point where the cup-shaped grinding stone makes contact with the lens surface moves from one outer peripheral edge to the other outer peripheral edge of the lens surface, past the lens center on the lens surface. In other words, the oscillation width of the cup-shaped grinding stone is changed in accordance with the size of the cup-shaped grinding stone, and the point where the cup-shaped grinding stone makes contact with the lens surface can be moved from the outer periphery of the lens surface, along the lens surface, to a position past the lens center. It is thereby possible to use cup-shaped grinding stones of various sizes.

In the spherical lens surface processing method of the present invention:

the lens is forcibly rotated at a lesser speed than the cup-shaped grinding stone; and the forced rotation state is ceased when the torque exerted on the lens by the frictional force between the lens surface and the sphere-center-oscillating cup-shaped grinding stone creates a passively rotatable state in which the lens can rotate passively following the cup-shaped grinding stone at a speed greater than the forced rotation speed.

For example, in cases such as when the lens surface is processed from a flat surface to a concave spherical surface, there are cases in which the torque needed for dependent rotation may not be achieved due to the state in which the cup-shaped grinding stone is in contact with the lens at the start of grinding. In the present invention, the lens is forcibly rotated, and is switched to dependent rotation at the point in time when the torque needed for dependent rotation is achieved. The cup-shaped grinding stone can thereby be reliably prevented from digging into the lens; therefore, the processing roughness of the lens surface can be improved, and undulation in the lens surface can be prevented.

In the spherical lens surface processing method of the present invention, preferably:

the lens, having been brought into contact with the cup-shaped grinding stone, is supported by an elastic stretching member; and the cup-shaped grinding stone and the lens are brought into contact by the elastic force produced by the stretching of the elastic stretching member.

To eliminate tool marks caused by the cup-shaped grinding stone digging into the lens, the lens is preferably held so that excessive pushing force is not generated between the lens surface and the cup-shaped grinding stone. I n the present invention, the lens is supported using the elastic stretching member, and excessive force generated between the lens and the cup-shaped grinding stone can be released by the elastic deformation of the elastic stretching member. It is thereby possible to prevent tool marks from being produced.

Next, in the spherical lens surface processing method of the present invention:

the lens is preferably held with vacuum suction by a lens holder in order to stabilize the lens thickness and align the optical axes of spherical surfaces processed on both surfaces of the lens.

It is thereby possible to obtain a spherical lens surface in which, after one lens surface has been processed to a spherical surface, the processing standard is already processed in the processing of the other lens surface. Consequently, it is possible to accurately detect the centers of both lens surfaces, and also the distance from the center of one lens surface to the center of the other lens surface, and it is therefore possible to align the optical axes and to stabilize the thickness.

Next, the spherical lens surface processing apparatus of the present invention for performing spherical lens surface processing according to the above-described method, the spherical lens surface processing apparatus including:

a cup-shaped grinding stone;

a grinding stone rotation mechanism that rotates the cup-shaped grinding stone about a central axis;

a lens holder that holds a lens to be processed;

a lens movement mechanism that moves a lens held in the lens holder so that a lens surface of the lens moves in directions towards and away from the cup-shaped grinding stone;

a sphere center oscillation mechanism that causes the cup-shaped grinding stone to oscillate centered on a spherical center as an oscillation center along the lens surface of the lens held in the lens holder; and a controller that controls the grinding stone rotation mechanism, the lens movement mechanism, and the sphere center oscillation mechanism.

The controller is characterized by:

forming a contact state in which the rotating cup-shaped grinding stone is brought into contact with the lens surface at a predetermined pressure; and while the contact state is maintained, forming a sphere center oscillation state in which the cup-shaped grinding stone oscillates along the lens surface centered on a sphere center as an oscillation center, to grind the lens surface to a spherical surface having a predetermined surface precision and center thickness, wherein, in the sphere center oscillation state, a distance from the oscillation center of the sphere center oscillation to the point where the cup-shaped grinding stone makes contact with the lens surface is set to be equal to the radius of the spherical surface; and an oscillation width of the sphere center oscillation is set so that the point where the cup-shaped grinding stone makes contact with the lens surface moves past a lens center on the lens surface, from one outer peripheral edge to the other outer peripheral edge of the lens surface.

The spherical lens surface processing apparatus of the present invention preferably has, in addition to the configuration described above, a forced rotation mechanism that forcibly rotates the lens holder about a central axis thereof, and a one-way clutch capable of ceasing the forced rotation caused by the forced rotation mechanism. In this case, the controller forcibly causes the lens to rotate at a lesser speed than the cup-shaped grinding stone, and the one-way clutch is set so as to cease the forced rotation state when the torque exerted on the lens by the frictional force between the lens surface and the sphere-center-oscillating cup-shaped grinding stone creates a passively rotatable state in which the lens can rotate passively following the cup-shaped grinding stone at a speed greater than the forced rotation speed.

The spherical lens surface processing apparatus of the present invention preferably has, in addition to the configuration described above, an elastic stretching member that supports the lens holder from the direction along the holder central axis, and brings the lens surface of the lens held in the lens holder into contact with the cup-shaped grinding stone at a predetermined force. The elastic force produced by the stretching of the elastic stretching member becomes a contact force with which the cup-shaped grinding stone is brought into contact with the lens surface.

The spherical lens surface processing apparatus of the present invention preferably has a vacuum suction-holding mechanism in addition to the configuration described above, and the lens holder is preferably designed to hold the lens through vacuum suction-holding force provided by the vacuum suction-holding mechanism.

MODE FOR CARRYING OUT THE INVENTION

Below is a description, made with reference to the drawings, of an embodiment of a spherical lens surface processing apparatus in which the present invention is applied.

Figure 1:
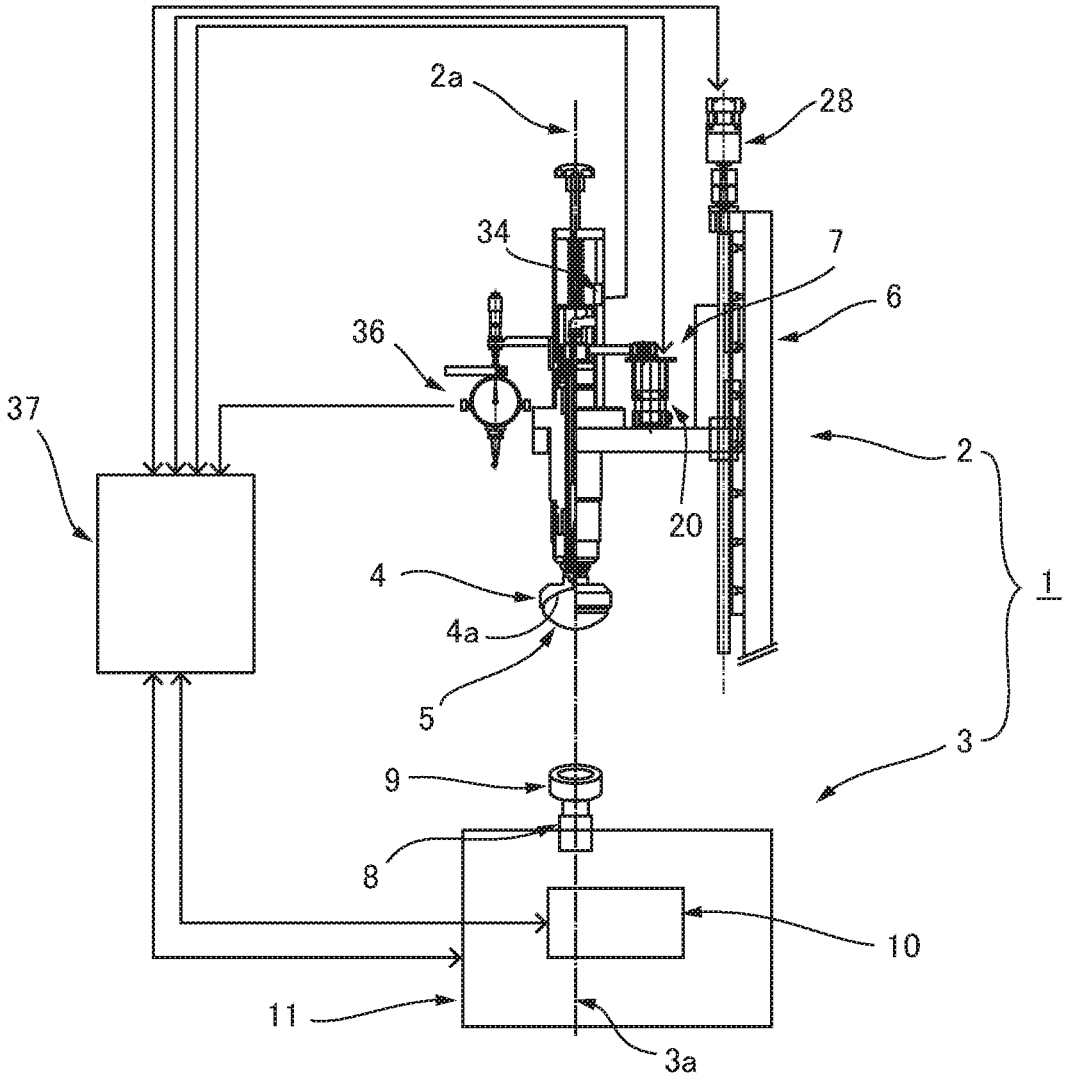
FIG. 1 is an explanatory drawing showing a spherical lens surface processing apparatus in which the present invention is applied.

FIG. 1 is a schematic configuration diagram showing a spherical lens surface processing apparatus. The spherical lens surface processing apparatus 1 is provided with an upper axis unit 2 and a lower axis unit 3 disposed thereunder. In the initial state, the lower axis unit 3 is disposed coaxially with the upper axis unit 2. The upper axis unit 2 is disposed in a vertically extending state, and a lens holder 4 is attached in a downward orientation to the lower end thereof. A lens 5 to be processed can be held by vacuum suction on a downward-oriented lens-holding surface 4*a* of the lens holder 4. The lens holder 4 can be moved in the direction of an upper axis unit central axis 2*a* by a raising/lowering mechanism 6. The lens holder 4 can also be rotated about the upper axis unit central axis 2*a* by a lens-rotating mechanism 7.

A grinding stone spindle 8 extends at the upper end of the lower axis unit 3, and a cup-shaped grinding stone 9 is attached to the tip end of the lower axis unit 3. The cup-shaped grinding stone 9 is provided with a cylindrical barrel part, and a disc-shaped bottom plate part that seals the rear end thereof. An annular end surface at the tip end of the cylindrical barrel part, a circular inner peripheral surface portion of a predetermined width joined to the inner peripheral edge of the annular end surface, and a circular outer peripheral surface portion of a predetermined width joined to the outer peripheral edge of the annular end surface, constitute a grinding stone surface. The cup-shaped grinding stone 9 can be rotated about a lower axis unit central axis 3*a* by a grinding-stone-rotating mechanism 10. The cup-shaped grinding stone 9 can also be caused by a sphere center oscillation mechanism 11 to undergo sphere center oscillation centered about a sphere center positioned on the upper axis unit central axis 2*a*, or on a line extended therefrom. Various publicly known structures can be used for the sphere center oscillation mechanism 11, and a description of the detailed configuration of this mechanism is therefore omitted. For example, the mechanism proposed in the previously cited Patent Document 1 can be used.

Figure 2:
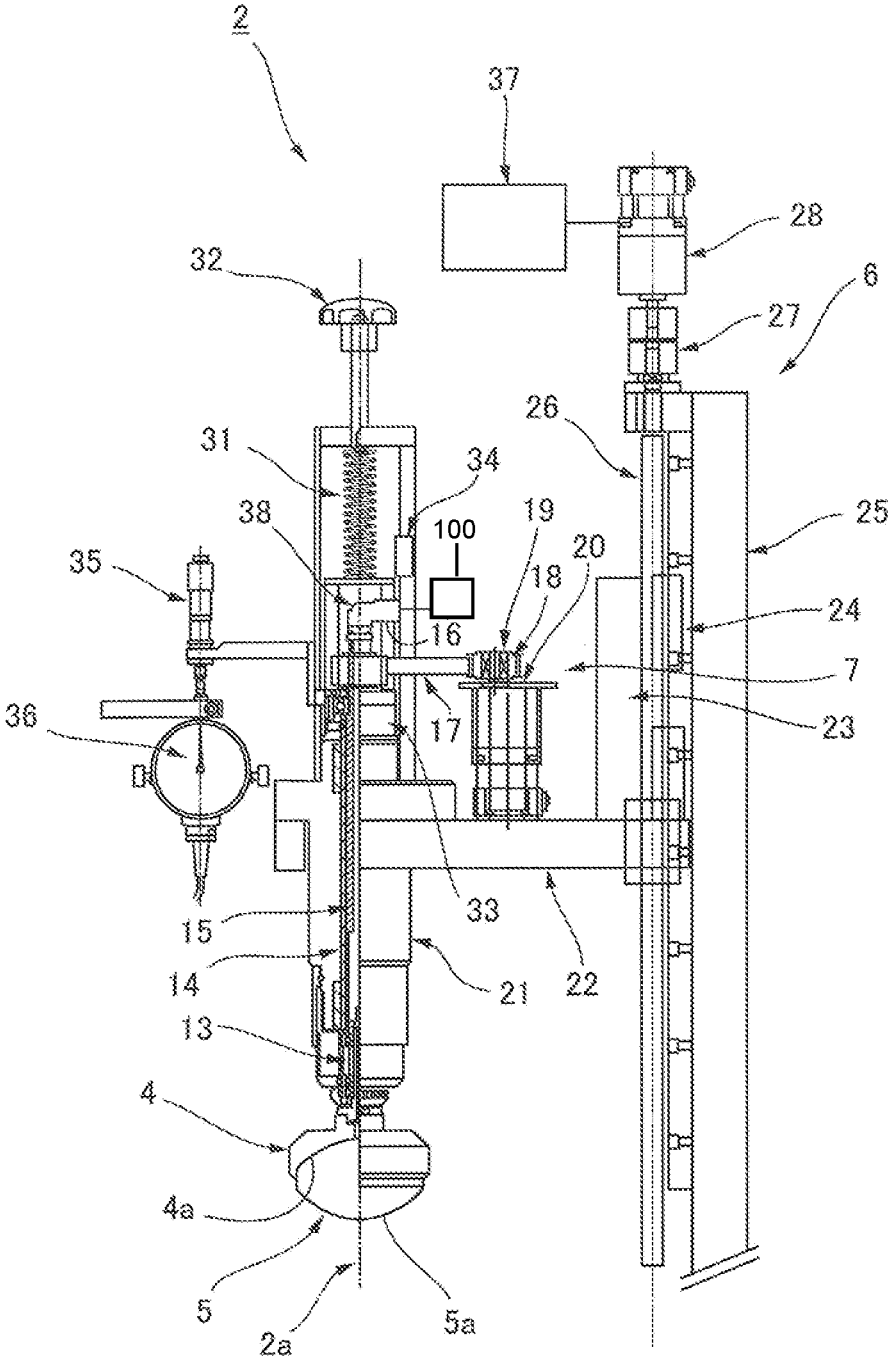
FIG. 2 is a configuration drawing showing an upper axis unit of FIG. 1.

FIG. 2 is an explanatory drawing showing the configuration of the upper axis unit 2. First, the lens-rotating mechanism 7 of the upper axis unit 2 is described. An upward-extending holder spindle 13 is coaxially attached to a rear surface part of the lens holder 4. The holder spindle 13 is rotatably held by a holder shaft 14 with a bearing interposed therebetween. Inside the holder shaft 14, a drive shaft 15 coaxially extends in a freely rotatable state. The lower end part of the drive shaft 15 coaxially meshes with the holder spindle 13 and causes the holder spindle 13 to rotate integrally. A driven-side pulley 16 is fixed to the upper end of the drive shaft 15, and the driven-side pulley 16 is coupled to a drive-side motor pulley 18 via a belt 17. The motor pulley 18 is linked to a motor shaft of a lens-rotating motor 20 via a one-way clutch 19.

Rotation in one direction only from the lens-rotating motor 20 is transmitted to the holder spindle 13 via the one-way clutch 19, and the lens holder 4 rotates about the upper axis unit central axis 2*a*. As viewed from the side of the lens holder 4, when the lens holder 4 rotates at a higher speed than that of the forced rotation caused by the lens-rotating motor 20 and in the same direction as the forced rotation, the lens holder 4 is disconnected from the lens-rotating motor 20 by the one-way clutch 19.

The raising/lowering mechanism 6 shall be described. The holder shaft 14 is disposed coaxially inside a holder sleeve 21 via a metal bearing and is free to move vertically. The holder sleeve 21 is supported by a horizontal arm 22. The horizontal arm 22 is attached to an arm base 23. The arm base 23 is supported, via a guide 24, to be free to move vertically by a vertically extending apparatus frame 25. The horizontal arm 22 can be moved vertically by an arm feed motor 28 joined to an arm feed screw 26 via a coupling 27.

With the interposition of a vertically extending compression spring 31, the holder shaft 14 is supported by a pressure adjustment bolt 32 from the upper side along the direction of the upper axis unit central axis 2*a*. The pressure adjustment bolt 32 is attached to the upper-end-side portion of the holder sleeve 21. During processing, contact force between the lens 5 held in the lens holder 4 on the lower-end side of the holder shaft 14 and the cup-shaped grinding stone 9 of the lower axis unit 3 positioned under the lens is set by the compression spring 31. The contact force can be increased when the pressure adjustment bolt 32 is screwed downward, and the contact force can be reduced when the bolt is unscrewed upward. The compression spring 31 also functions as a pressure release mechanism for preventing excessive pushing force from occurring between the lens 5 and the cup-shaped grinding stone 9.

A sensor 34 attached to the holder sleeve 21 is disposed to the side of a shaft head 33 at the upper end of the holder shaft 14. The upper limit position of the holder shaft 14 is detected by the sensor 34.

A micro head 35 is attached to the shaft head 33. A dial gauge 36 is disposed at the lower side of the micro head 35. The dial gauge 36 is attached to the apparatus frame 25 and the position of the gauge is fixed. The dial gauge 36 detects changes in the amount by which the micro head 35 pushes. To regulate the pushing amount, limit switches are provided to detect the raised end and lowered end of the micro head 35. On/off signals of each of the limit switches are delivered to an NC controller 37.

The vacuum used to hold the lens 5 by vacuum suction to the lens holder 4 is supplied from a vacuum source (not shown) to the lens-holding surface 4*a* through a rotary joint 38, a communication hole in the drive shaft 15, a communication hole in the holder spindle 13, and a center hole provided to the lens holder 4.

Oscillation Range of Cup-Shaped Grinding Stone

Figure 3:
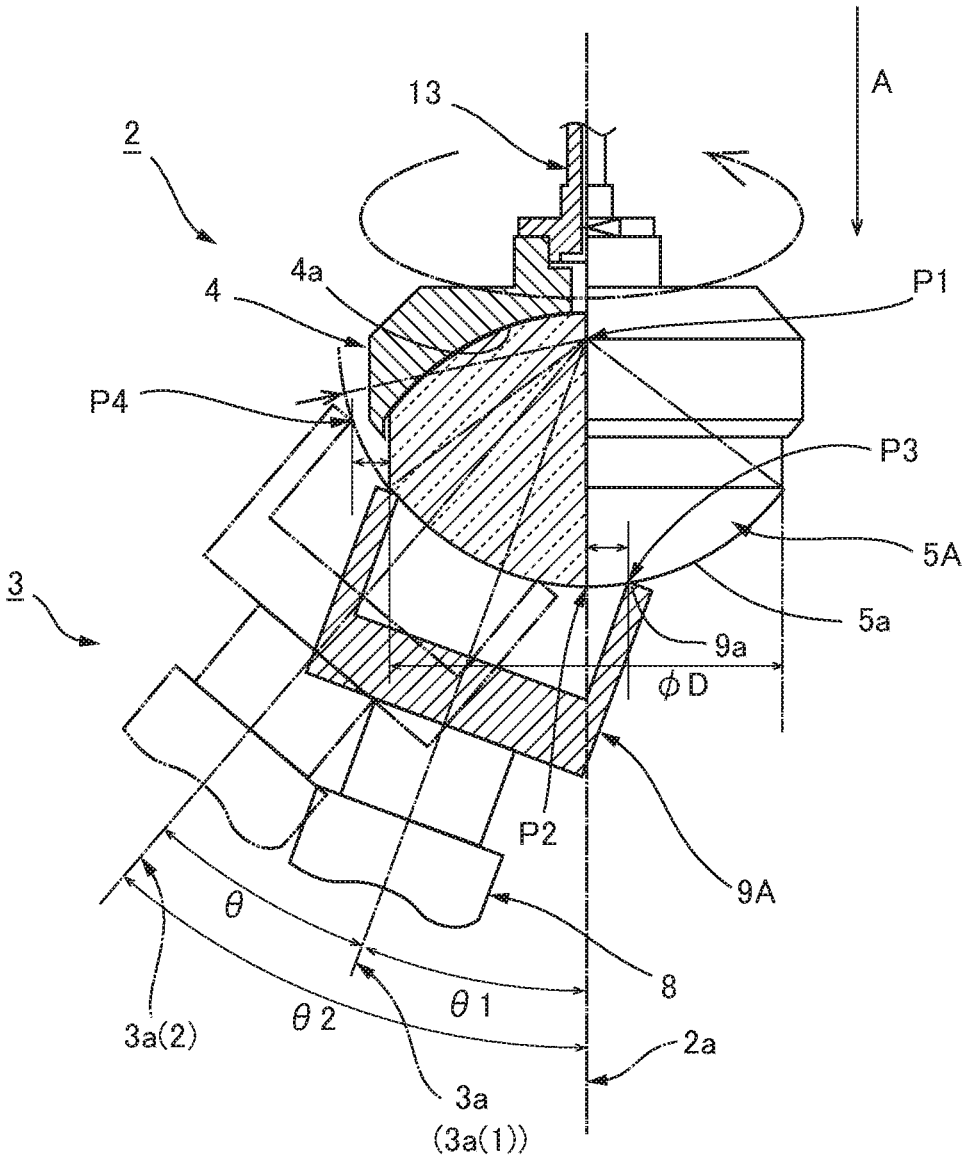
FIG. 3 is an explanatory drawing of a case in which a cup-shaped grinding stone is caused to undergo sphere center oscillation to grind a convex spherical lens surface.
Figure 4:
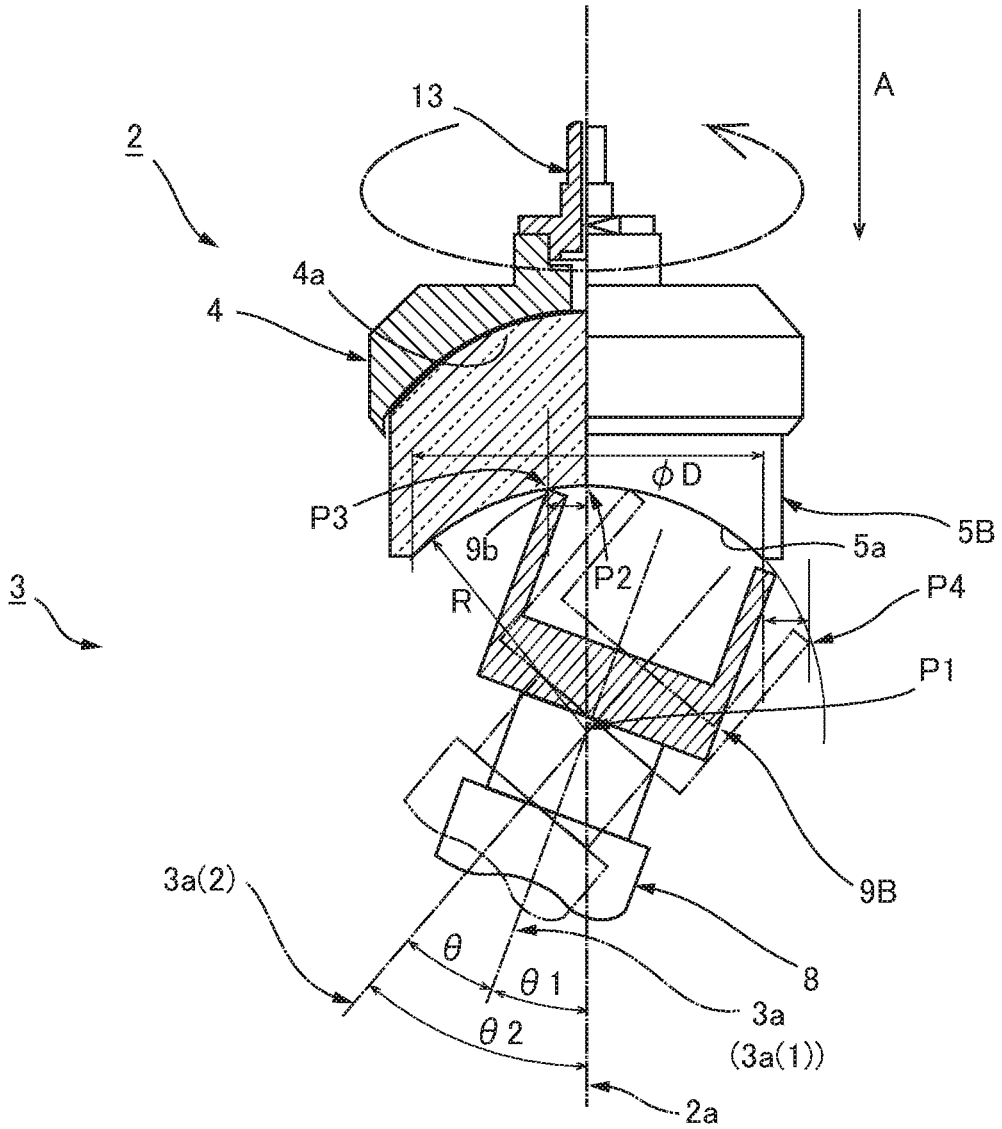
FIG. 4 is an explanatory drawing of a case in which a cup-shaped grinding stone is caused to undergo sphere center oscillation to grind a concave spherical lens surface.

FIG. 3 is an explanatory drawing showing the processing principle when the cup-shaped grinding stone is caused to undergo sphere center oscillation to grind a convex spherical lens surface, and FIG. 4 is an explanatory drawing showing the processing principle when the cup-shaped grinding stone is caused to undergo sphere center oscillation to grind a concave spherical lens surface. These drawings are used as references to describe the oscillation range of the cup-shaped grinding stone 9 relative to the lens 5. For the lens 5, the convex lens shown in FIG. 3 is referred to as a lens 5A and the concave lens shown in FIG. 4 is referred to as the lens 5B, and for the cup-shaped grinding stone 9, the stone used on the convex lens 5A shown in FIG. 3 is referred to as the cup-shaped grinding stone 9A and the stone used on the concave lens 5B of FIG. 4 is referred to as the cup-shaped grinding stone 9B.

The cup-shaped grinding stone 9A (9B) undergoes sphere center oscillation in conformity with the curvature of a lens surface 5*a* of the lens 5A (5B) being processed. An oscillation center P1 of the sphere center oscillation is set so as to be positioned on a lens rotation central line or on the upper axis unit central axis 2*a*. Axes 3*a*(1), 3*a*(2) define the oscillation range of the cup-shaped grinding stone 9, the angle θ between these lines indicates the oscillation width of the cup-shaped grinding stone 9, and the cup-shaped grinding stone 9 moves reciprocatingly within the range of this angle θ, along the lens surface 5*a*.

The angle θ1 is the angle between the upper axis unit central axis 2*a* and one axis 3*a*(1) defining the oscillation range and passing through the oscillation center P1. The angle θ2 is the angle between the upper axis unit central axis 2*a* and the other axis 3*a*(2) defining the oscillation range and passing through the oscillation center P1.

The oscillation range (angles θ1, θ2) of the cup-shaped grinding stone 9 is set as follows. A cross-sectional plane is envisioned, which is a cross-section of the lens 5 and the cup-shaped grinding stone 9 cut along a vertical plane including the lens center axis (the upper axis unit central axis 2*a*) and the grinding stone center axis (the lower axis unit central axis 3*a*). The oscillation range is set so that in this cross-sectional plane, the edge end of the cup-shaped grinding stone 9 that contacts the lens surface 5*a* can move past the lens center along the lens surface 5*a*. In addition, the oscillation range is set so that the grinding stone edge end can move to a position off the outer peripheral edge of the lens surface 5*a*.

In the present example, the angles θ1, θ2 are set as follows, as shown in FIGS. 3 and 4. φD is the chord length of the arc of the lens surface 5*a* of the lens 5A (5B) being processed, P2 is the lens center on the lens surface 5*a,* and P3 is a position moved from the lens center P2 by a distance equivalent to 10% of the chord length φD. The angle θ1 is set so that the point where the cup-shaped grinding stone 9 makes contact with the lens surface 5*a,* i.e., the grinding stone edge end 9*a* (9*b*) where the cup-shaped grinding stone 9 contacts the lens surface 5*a,* is the position P3.

A position P4 of the cup-shaped grinding stone 9 is a position apart from the outer peripheral edge of the lens surface 5*a* by a distance, the distance being equivalent to 10% of the chord length φD of the arc of the lens surface 5*a* of the lens 5A (5B) being processed, is denoted as P4. The angle θ2 is set so that the grinding stone edge end 9*a* (9*b*) where the cup-shaped grinding stone 9 contacts the lens surface 5*a* is moved to the position P4.

Lens Grinding Action

The grinding performed by the sphere center oscillation-type spherical lens surface processing apparatus 1, having the cup-shaped grinding stone 9, is performed as follows. First, in the upper axis unit 2, the lens 5 is held by suction in the lens holder 4. The lens-rotating motor 20 is driven, and the rotation of the motor is transmitted to the lens holder 4 via the one-way clutch 19. The lens 5 thereby begins to rotate. The rotation of the cup-shaped grinding stone 9 is started in the lower axis unit 3 as well, and the rotating cup-shaped grinding stone 9 is tilted at the angle θ1.

In this state, the holder sleeve 21 is lowered by the raising/lowering mechanism 6. The lens holder 4 is also lowered, and the lens surface 5*a* of the lens 5 held in the lens holder 4 comes into contact with the grinding stone edge of the cup-shaped grinding stone 9. After this state has been formed, the holder sleeve 21 is lowered further. The holder shaft 14 holding the lens holder 4 can slide vertically in relation to the holder sleeve 21. Consequently, the holder shaft 14 is pushed relatively upward, the shaft head 33 thereof pushes in the compression spring 31 upward, and due to the spring force of the pushed-in compression spring, the lens surface 5*a* is pushed against the cup-shaped grinding stone 9 with a predetermined force. When the holder sleeve 21 is lowered further, the sensor 34 detects the shaft head 33. The NC controller 37 stops the raising/lowering mechanism 6.

The sphere center oscillation mechanism 11 of the lower axis unit 3 is then driven, and the sphere center oscillation of the cup-shaped grinding stone 9 is started between the angles θ1, θ2. At this time, grinding is performed while pressure is exerted on the lens 5 with the pressure set by the compression spring 31.

At the start of grinding, the lens 5 is forcibly rotated by the lens-rotating motor 20 at 500 to 1000 rpm in the same direction as the cup-shaped grinding stone 9. As grinding proceeds, the torque causing the lens 5 to rotate due to the frictional force between the lens 5 and the cup-shaped grinding stone 9 increases, and the lens 5 rotates passively with respect to the cup-shaped grinding stone 9. In other words, when the rotational speed of the dependent rotation exceeds the forced rotational speed reliant on the lens-rotating motor 20, the motive power transmission path from the lens-rotating motor 20 is cut off by the operation of the one-way clutch 19, and the lens 5 switches from the forced rotating state to the passively rotation state caused by the cup-shaped grinding stone 9.

As the grinding progresses and the thickness of the lens 5 decreases, the shaft head 33 of the holder shaft 14 pushed by the compression spring 31 falls. The sensor 34 turns off upon the shaft head 33 falling. When the sensor 34 turns off, the raising/lowering mechanism 6 is driven to lower the holder sleeve 21, and a state is formed in which the lens 5 is again pressed against the cup-shaped grinding stone 9 with a predetermined pressure. The grinding of the lens 5 is caused to progress while this action is repeated.

As grinding progresses further, the micro head 35 attached to the shaft head 33 comes into contact with the dial gauge 36, and the dial gauge 36 is pushed in. When the dial gauge 36 is pushed in and the limit switch at the lowered end turns on, processing is complete. The NC controller 37 causes the sphere center oscillation and rotation of the cup-shaped grinding stone of the lower axis unit 3 to stop, and drives the raising/lowering mechanism 6 of the upper axis unit 2 to raise the lens 5. After the lens 5 has been raised to a predetermined position, the suction holding of the lens 5 is ceased and the lens 5 can be taken out of the lens holder 4.

Effects of the Invention

It has been confirmed that the processed shape of the lens surface 5*a* can be made into a perfect sphere by causing the cup-shaped grinding stone 9 to undergo sphere center oscillation within the oscillation range set as described above.

Particularly, it has been confirmed that there are no depressions or protrusions whatsoever in the lens center of the lens surface 5*a*.

To adjust the curvature change in the lens surface 5*a* due to wear of the cup-shaped grinding stone 9, it is sufficient merely to measure the curved surface of the actually processed lens and change the sphere center oscillation radius using the deviation from the target curved surface as a corrective value for the locus of the sphere center oscillation of the cup-shaped grinding stone 9. Moreover, complex calculations are not needed because the corrective value may be simply an actual measured value. Using the cup-shaped grinding stone 9, it is thereby possible to achieve spherical surface precision that could only be achieved in the prior art with a plate-shaped grinding stone.

Excessive pressure acting in a lateral direction (the direction of lens rotation) can be released by allowing the lens 5 to rotate passively with respect to the cup-shaped grinding stone 9. It is also possible, by keeping the pressure force of the compression spring 31 constant, to prevent the cup-shaped grinding stone 9 from digging into the lens 5. This prevents any tool marks from being formed in the lens surface 5*a*. Due to the lens 5 rotating passively with respect to the cup-shaped grinding stone 9, the relative speed between the lens and the stone is always optimal, and undulation in the lens surface 5*a* is therefore also eliminated.

Concerning surface roughness, the amount by which the diamond particles of the cup-shaped grinding stone 9 dig into the lens 5 can be adjusted by adjusting the pressure force exerted by the compression spring 31. It has been confirmed that it is thereby possible to achieve the same surface roughness as with a plate-shaped grinding stone.

After one lens surface has been processed, the lens 5 is held with the processed lens surface vacuum-suctioned to the lens holder 4. Therefore, the spherical lens surfaces formed in both surfaces of the lens naturally have aligning optical axes. Additionally, because the previously processed spherical lens surface is held by suction to the lens holder 4, it is possible to accurately measure the position where processing finishes on the other surface of the lens 5. It is thereby possible to accurately process the thickness of the lens center part and to keep the thickness constant.

Figure 5A:
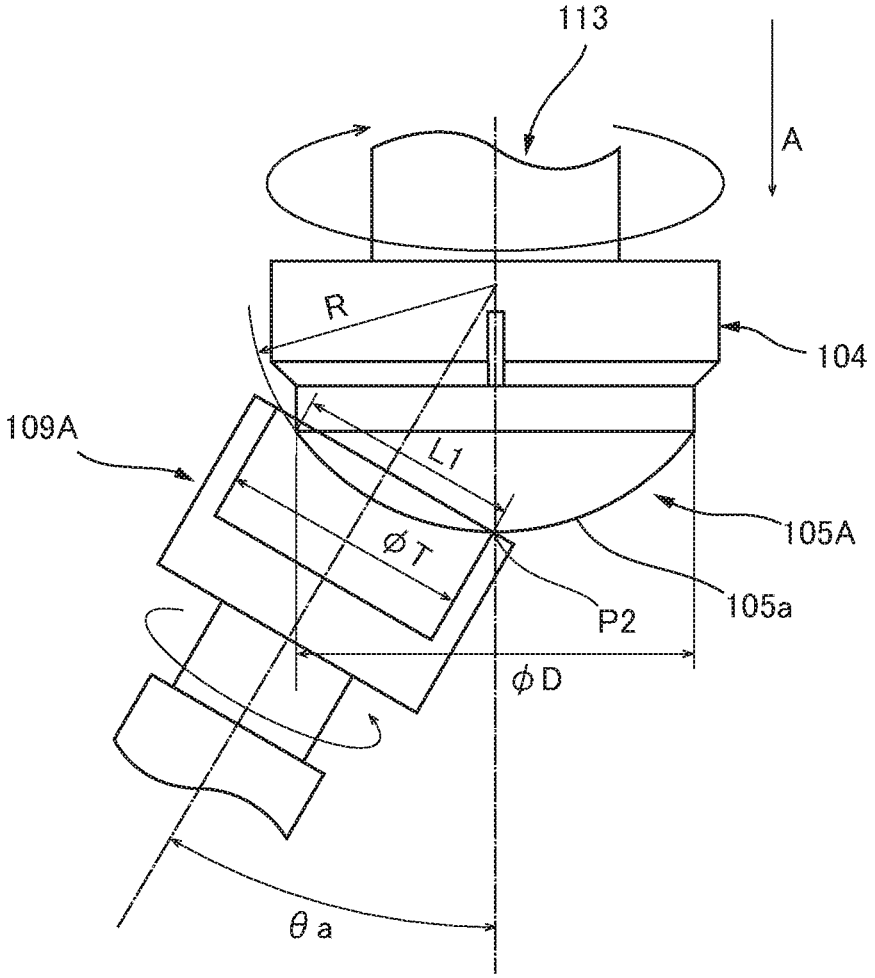
FIG. 5A is an explanatory drawing showing the action whereby a prior-art CG machine grinds a convex spherical lens surface.
Figure 5B:
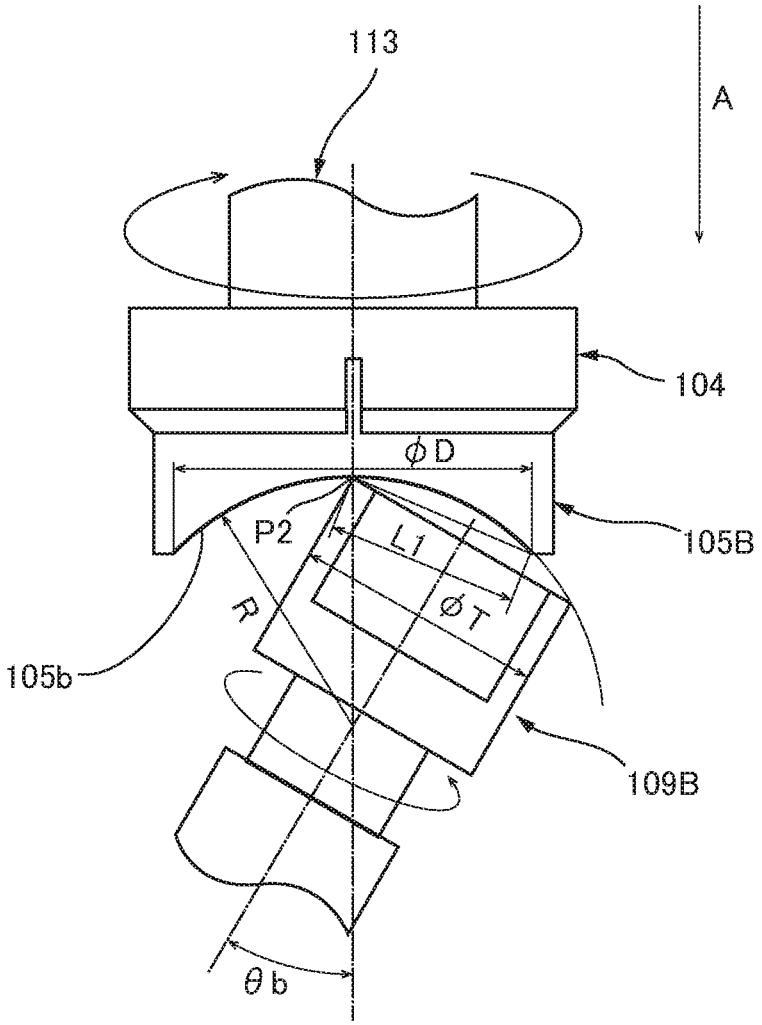
FIG. 5B is an explanatory drawing showing the action whereby a prior-art CG machine grinds a concave spherical lens surface.

Due to the cup-shaped grinding stone being caused to undergo sphere center oscillation, a small-sized cup-shaped grinding stone can be used. Specifically, it is possible to use a cup-shaped grinding stone having a contact diameter φT that is shorter than the chord length L1 from the lens center to the outer peripheral edge in the surface of a lens of radius R, which had been a necessity in the prior art, as shown in FIGS. 5A and 5B, and the versatility of the cup-shaped grinding stone can be increased.

The invention claimed is:

1. A spherical lens surface processing method, the method including the steps of:

forming a contact state in which a rotating cup-shaped grinding stone is brought into contact at a predetermined pressure with a lens surface of a glass lens to be processed; and while maintaining the contact state, forming a state of sphere center oscillation in which the cup-shaped grinding stone oscillates along the lens surface centered on a sphere center as an oscillation center, and grinding the lens surface to a spherical surface having a predetermined surface precision and center thickness;

wherein, in the state of sphere center oscillation, a distance from the oscillation center to a contact point where the cup-shaped grinding stone makes contact with the lens surface is set to be equal to a radius of the sphere surface;

an oscillation width of the sphere center oscillation is set so that the contact point where the cup-shaped grinding stone makes contact with the lens surface moves past a lens center on the lens surface, from one outer peripheral edge side to the other outer peripheral edge side of the lens surface;

the lens is forcibly rotated at a lesser speed than the cup-shaped grinding stone; and a forced rotation state of the lens is ceased when a torque exerted on the lens by a frictional force between the lens surface and the cup-shaped grinding stone creates a passively rotatable state in which the lens can rotate passively following the cup-shaped grinding stone at a speed greater than a forced rotation speed of the lens, the cup-shaped grinding stone being in the state of sphere center oscillation.

2. The spherical lens surface processing method according to claim 1, wherein the lens, which is in contact with the cup-shaped grinding stone, is supported by an elastic stretching member; and the cup-shaped grinding stone and the lens are maintained in the contact state by an elastic force produced by stretching of the elastic stretching member.

3. The spherical lens surface processing method according to claim 1, wherein the contact state is formed in a state in which lens is held with vacuum suction by a lens holder.

4. A spherical lens surface processing apparatus, comprising:

a cup-shaped grinding stone;

a grinding stone rotation mechanism for rotating the cup-shaped grinding stone about a central axis thereof;

a lens holder for holding a lens to be processed;

a lens movement mechanism for moving the lens held in the lens holder so that a lens surface of the lens moves in directions towards and away from the cup-shaped grinding stone;

a sphere center oscillation mechanism for causing the cup-shaped grinding stone to oscillate centered on a sphere center as an oscillation center along the lens surface of the lens held in the lens holder; and a controller for controlling the grinding stone rotation mechanism, the lens movement mechanism, and the sphere center oscillation mechanism, wherein the controller has the functions of:

forming a contact state in which the cup-shaped grinding stone while rotating is brought into contact with the lens surface at a predetermined pressure;

while maintaining the contact state, forming a sphere center oscillation state in which the cup-shaped grinding stone oscillates along the lens surface centered on the sphere center, and grinding the lens surface to a spherical surface having a predetermined surface precision and center thickness;

in the sphere center oscillation state, setting a distance to be equal to a radius of the spherical surface, the distance being from an oscillation center of the sphere center oscillation to a contact point where the cup-shaped grinding stone makes contact with the lens surface; and setting an oscillation width of the sphere center oscillation so that the contact point where the cup-shaped grinding stone makes contact with the lens surface moves past a lens center on the lens surface, from one outer peripheral edge to the other outer peripheral edge of the lens surface;

the spherical lens surface processing apparatus according further comprising:

a forced rotation mechanism for forcibly rotating the lens holder about a central axis thereof; and a one-way clutch configured so as to cease forced rotation of the lens caused by the forced rotation mechanism, wherein the controller further has the function of:

forcibly causing the lens to rotate at a lesser speed than the cup-shaped grinding stone, and wherein the one-way clutch is set so as to cease the forced rotation of the lens when a torque exerted on the lens by a frictional force between the lens surface and the cup-shaped grinding stone creates a passively rotatable state in which the lens can rotate passively following the cup-shaped grinding stone at a speed greater than the forced rotation speed, the cup-shaped grinding stone being in the sphere center oscillating state.

5. The spherical lens surface processing apparatus according to claim 4, further comprising:

an elastic stretching member for supporting the lens holder from a direction along a holder central axis, and for bringing the lens surface of the lens held in the lens holder into contact with the cup-shaped grinding stone at a predetermined force.

6. The spherical lens surface processing apparatus according to claim 4, further comprising:

a vacuum suction-holding mechanism, wherein the lens holder is configured so as to hold the lens through vacuum suction-holding force provided by the vacuum suction-holding mechanism.

* * * * *